United States Patent [19]

Jacoby et al.

[11] 4,058,187

[45] Nov. 15, 1977

[54] LIMITED STOP ELEVATOR DISPATCHING SYSTEM

[75] Inventors: Herbert Jacoby, Spring Valley; Arnold Mendelsohn, New City, both of N.Y.

[73] Assignee: United Technologies Corporation, Hartford, Conn.

[21] Appl. No.: 610,510

[22] Filed: Sept. 4, 1975

[51] Int. Cl.[2] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 2,926,756 | 3/1960 | Hornung | 187/29 |
| 2,944,634 | 7/1960 | Magee | 187/29 |
| 3,353,631 | 11/1967 | Burgy | 187/29 |
| 3,422,928 | 1/1969 | Bruns | 187/29 |
| 3,589,472 | 6/1971 | Hallene et al. | 187/29 |

*Primary Examiner*—Robert K. Schaefer
*Assistant Examiner*—W. E. Duncanson, Jr.
*Attorney, Agent, or Firm*—Robert T. Mayer

[57] ABSTRACT

Apparatus for generating dispatching signals for a group of elevators operating between two terminals. The dispatching signals are generated at intervals computed in accordance with an estimated number of passengers the next car to be dispatched from each terminal will carry. This estimate is based on the actual number of passengers carried by previously dispatched cars. By functioning in this manner the apparatus distributes the passengers between the cars.

8 Claims, 6 Drawing Figures

LIMITED STOP ELEVATOR DISPATCHING SYSTEM

This invention relates to a dispatching system for a group of elevators. More particularly, it concerns apparatus for generating dispatching signals for use by a two terminal elevator control system having a limited number of stops.

An important function of any elevator dispatching system is to select and dispatch each of the cars of the system from each of the terminals at intervals which provide for a sharing of the passenger loading by each of the dispatched cars. In order to obtain such a sharing it is common practice to dispatch each car at intervals determined from the average round trip time of the cars divided by the number of cars in the system. Typically the round trip time includes the time a car remains at each terminal in addition to the time required for it to travel to the opposite terminal and return. In a system having stops between the terminals a car's travel time between terminals varies in accordance with the number of stops the car makes during such travel and the time passengers take to enter and leave the car at each stop. Since the running time between the terminal stops and the passenger delay time at each stop are variable in such a system, the determination of the dispatch interval requires complex and expensive equipment if such variables are taken into account in that determination.

The calculation of the dispatch interval provided even by such expensive equipment however has not been totally acceptable since it typically neglects calls registered for service at stops between the terminals after the car has been dispatched and for which the car may provide service.

Most elevator systems in which dispatching systems are employed typically have a larger number of passengers at one terminal than the other during certain periods of the day. In such instances in order to provide a more equitable sharing of the passenger loading it has been found desirable to modify the dispatching interval at each terminal whereby additional cars are made available to the terminal with the larger passenger loading.

It is an object of this invention to provide a simplified dispatching system for a two terminal elevator system having a limited number of stops.

It is another object of this invention to provide a dispatching system for sharing the passenger loading by each of the dispatched cars equally.

One of the features of the invention is that in response to a change in passenger loading it varies the dispatching interval at each terminal whereby a number of cars suitable to the loading at each terminal are made available to each of the respective terminals.

Another feature of the invention is that it generates a dispatching signal upon the elapse of a dispatching interval which is calculated from an estimate of the passenger loading.

Another feature of the invention is that it expedites the dispatch of a car when the signal representing the passenger loading in that car exceeds by a predetermined amount a signal signifying the passenger loading that car should have when its dispatching interval expires.

In accordance with the invention there is provided apparatus for generating dispatching signals for an elevator control system having a predetermined number of stops. Included in this apparatus is weight responsive means individual to each car which responds to the weight of the passengers in its respective car and produces signals representing that weight. Accumulation means and its associated signal transmission means receives the signals signifying the weight of the passengers in the cars and in response thereto generates signals representing an estimated loading for the next car to be dispatched from each terminal. In addition the apparatus of the present invention includes a means which computes a separation time period. This means responds to the estimated loading signals and produces signals representing the time period separating each dispatched car of the system from the car next preceding and the car next succeeding its dispatch if each of the cars is sharing equally the load. Car differential means producing signals representing the difference between the cars approaching and located at one terminal and those approaching and located at the other terminal during each dispatching interval that elapses are also included in the apparatus. The apparatus also comprises loading differential means producing signals signifying the difference between the estimated load at each of the terminals during each dispatching interval. A dispatching interval generating means responsive to the signals representing the computed separation time period and to the signals signifying the car and loading differentials also forms part of the apparatus and generates signals representing a dispatching interval for each terminal. A dispatching signal generator generates dispatch signals in response to the elapsing of the dispatching intervals.

Other objects and features of the invention will be apparent from the foregoing and the following description when considered in conjunction with the appended claims and the accompanying drawing in which:

Figure 3:
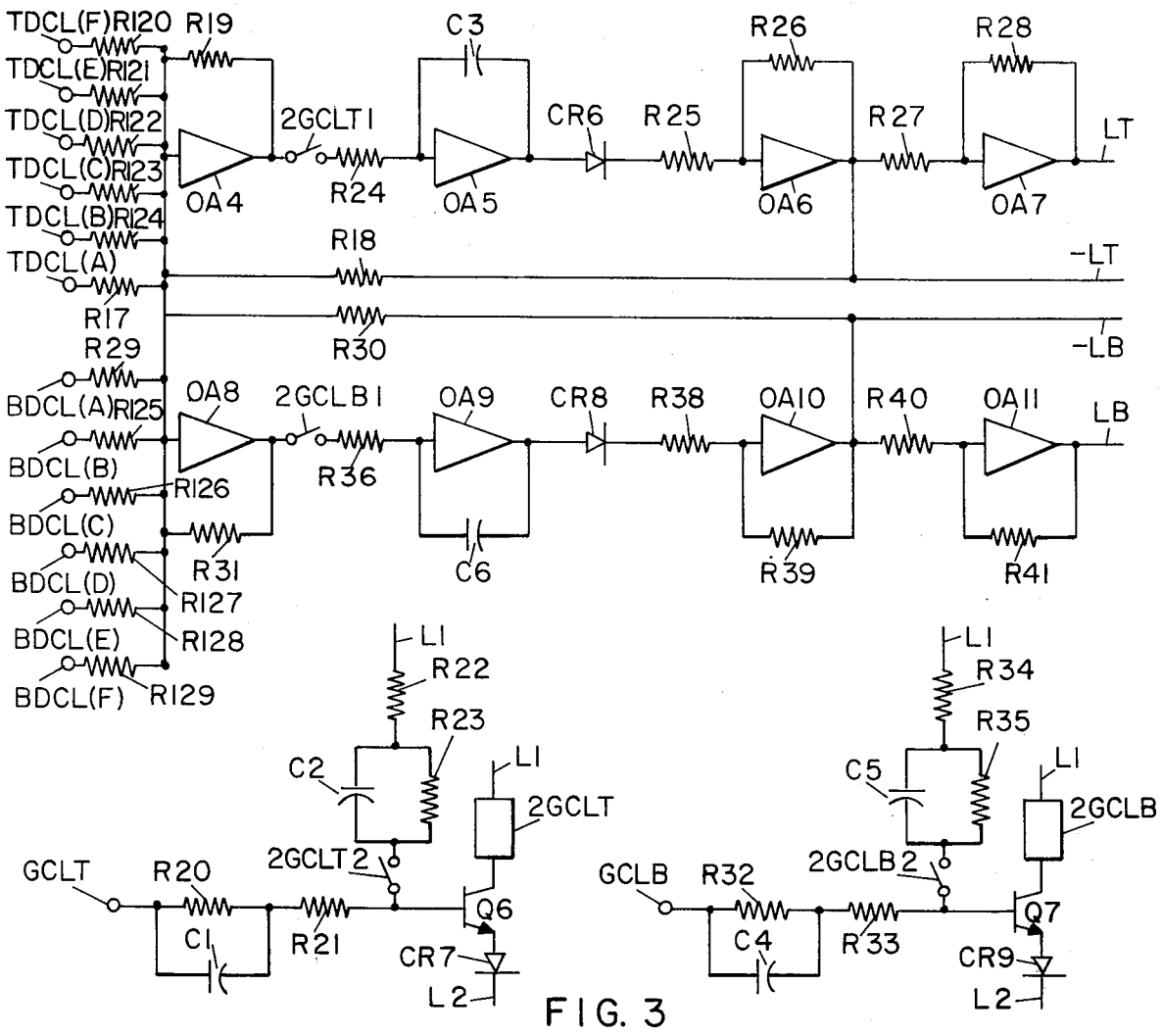
Figure 5:
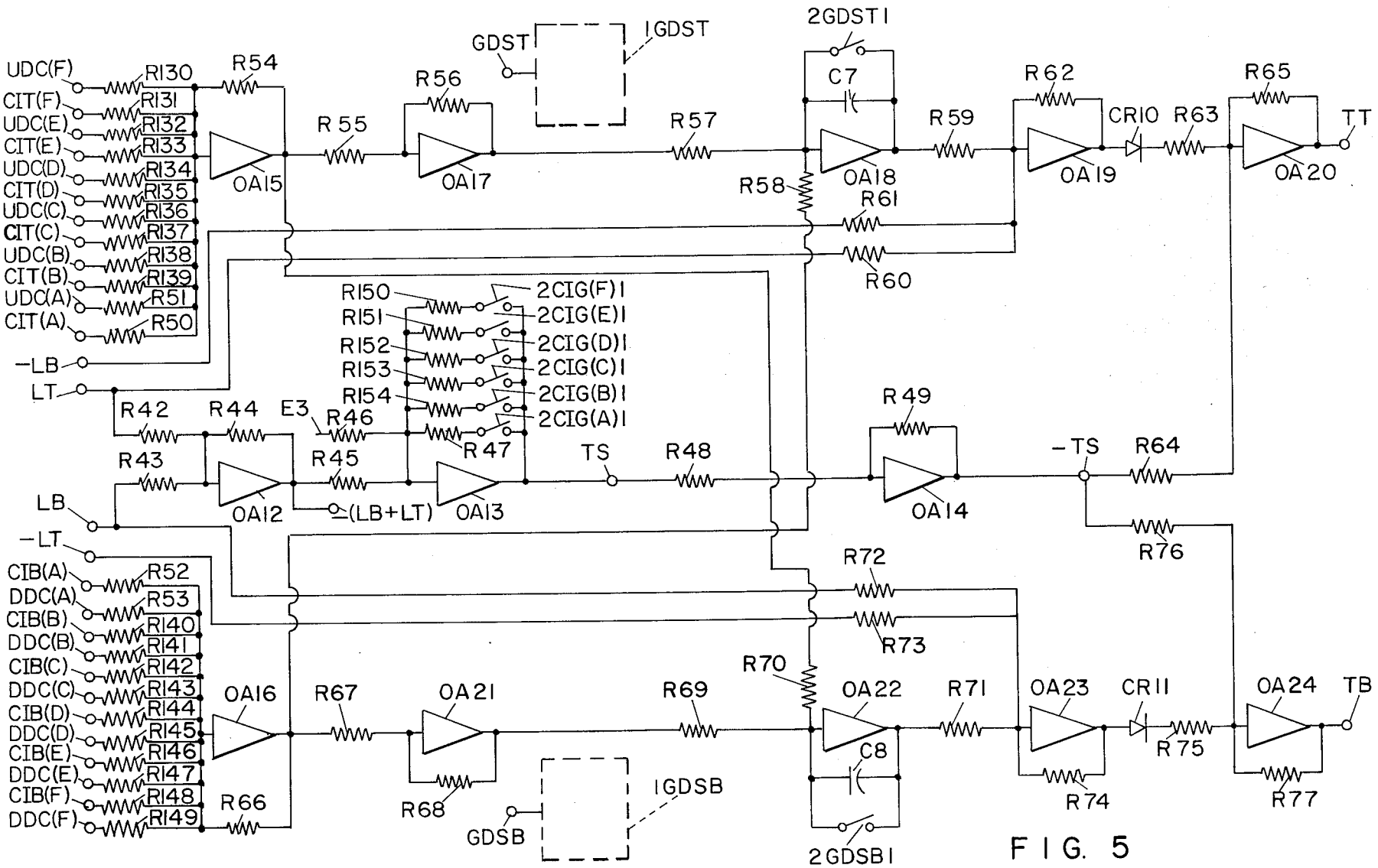
Figure 6:
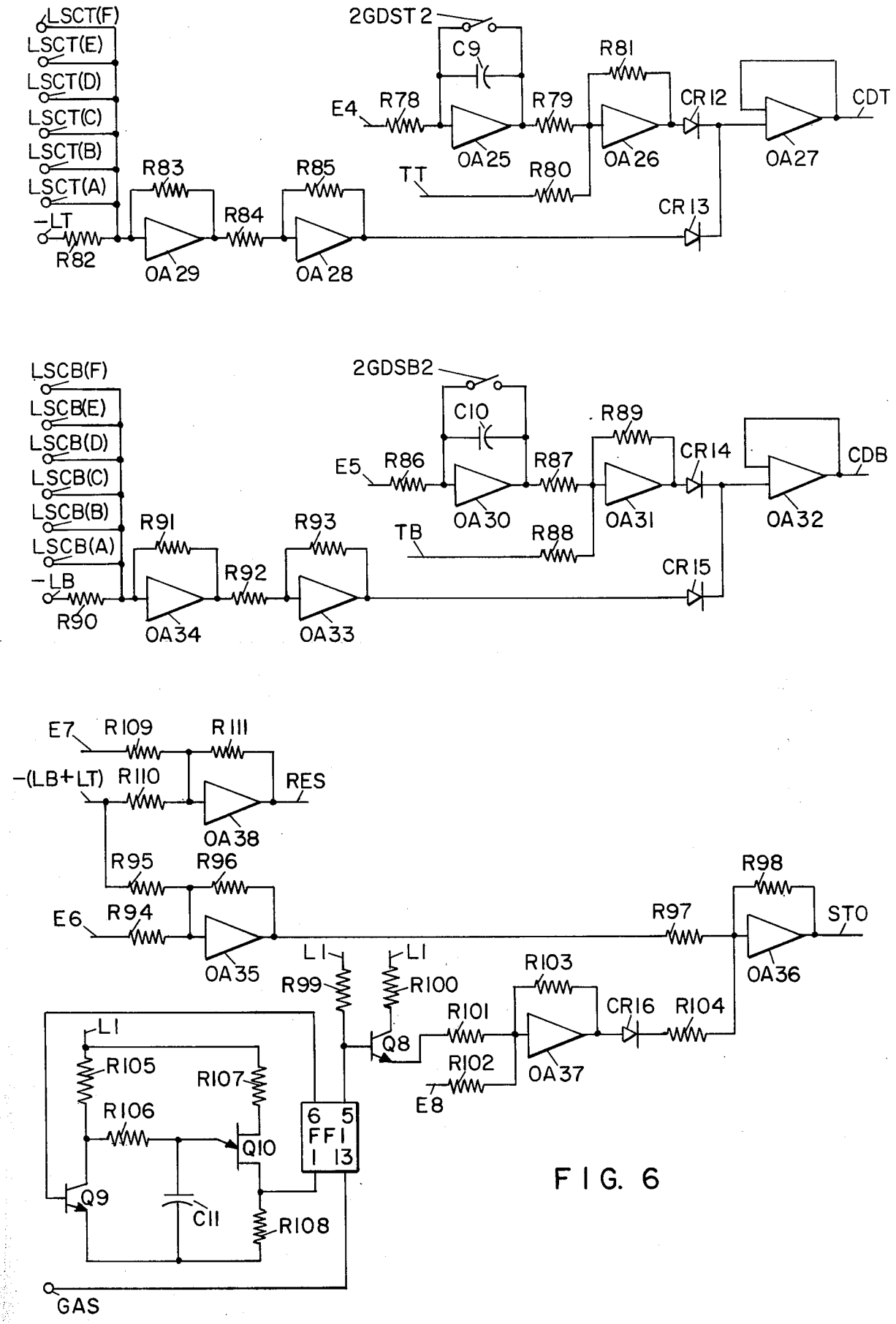

FIGS. 3, 5 and 6 taken together comprise a simplified schematic diagram of the apparatus of the presently preferred embodiment of the invention common to all the cars.

Figure 4:
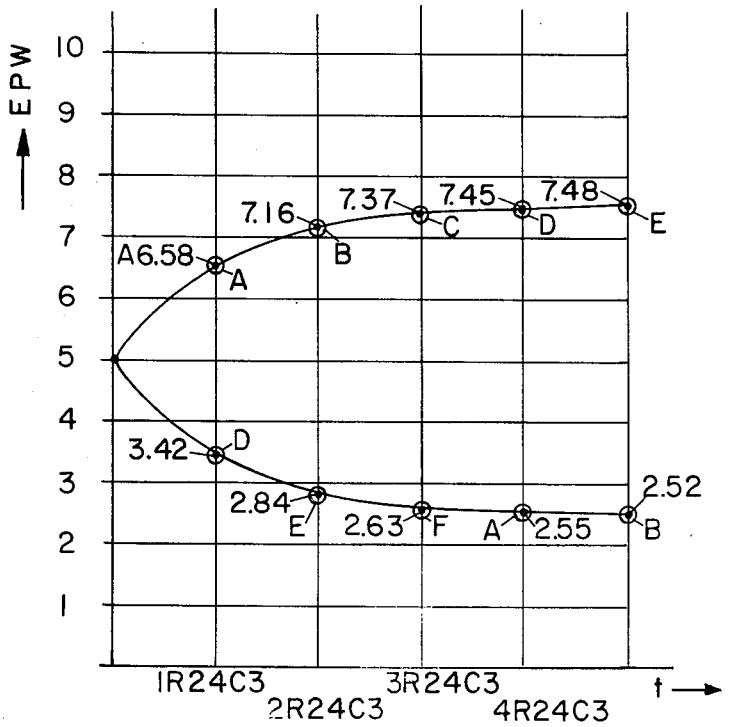

FIG. 4 is a graph of the estimated passenger weight (EPW) plotted against time ($t$) illustrating two exponential curves signifying the manner of obtaining the estimated weight of passengers in cars to be dispatched.

Separately listed below are the names of signals generated by the elevator control system for use by the apparatus of the present invention and the names of the signals generated by that apparatus for use by the elevator control system. Listed adjacent those names are reference characters shown in the drawing and utilized throughout the specification to identify those signals. Signals individual to each car are denoted by parenthesis appended to the reference characters representing those signals. The capital letters A, B, C, D, E or F when placed within those parenthesis identifies the car to which the signal is referenced.

| | |
|---|---|
| Up dispatched car | UDC ( ) |
| Down dispatched car | DDC ( ) |
| Car idle at bottom | CIB ( ) |
| Car idle at top | CIT ( ) |
| Car leaving bottom terminal | CLB ( ) |
| Car leaving top terminal | CLT ( ) |
| Selected car at bottom | SCB ( ) |
| Selected car at top | SCT ( ) |
| Car load measurement | LLW ( ) |
| Car in group | CIG ( ) |

-continued

| | |
|---|---|
| Group car accepts dispatch at bottom | GDSB ( ) |
| Group car accepts dispatch at top | GDST ( ) |
| Group car leaving bottom | GCLB |
| Group car leaving top | GCLT |
| Group accepts storage | GAS |
| - - - - - - - - - - - - | |
| Car dispatch bottom | CDB |
| Car dispatch top | CDT |
| Restore signal to group | RES |
| Store signal | STO |

Various impedances - resistors and capacitors illustrated in the drawing are designated by the characters R and C respectively with appropriate numerical suffixes appended to those characters to differentiate one element from another.

Similarly, the reference characters CR with an appropriate numerical suffix identifies each of the rectifiers illustrated in the drawing.

Reference characters L1, L2 and L3 shown in the drawing represent respectively the positive supply voltage, the voltage return and the negative supply voltage connections to the lines identified with those reference characters. In addition each reference character E with an appropriate numerical suffix shown in the drawing represents predetermined voltage used as bias signal applied along the line so referenced.

Solid line triangular blocks shown in the drawing represent linear amplifiers typically known as operational amplifiers. Affixed to each of the illustrated operational amplifiers are the reference characters OA with an appropriate numerical suffix. These amplifiers with the proper choice of the input and feedback impedances are used as summing amplifiers, inverting amplifiers, voltage followers, comparators and integrating amplifiers.

Figure 2:
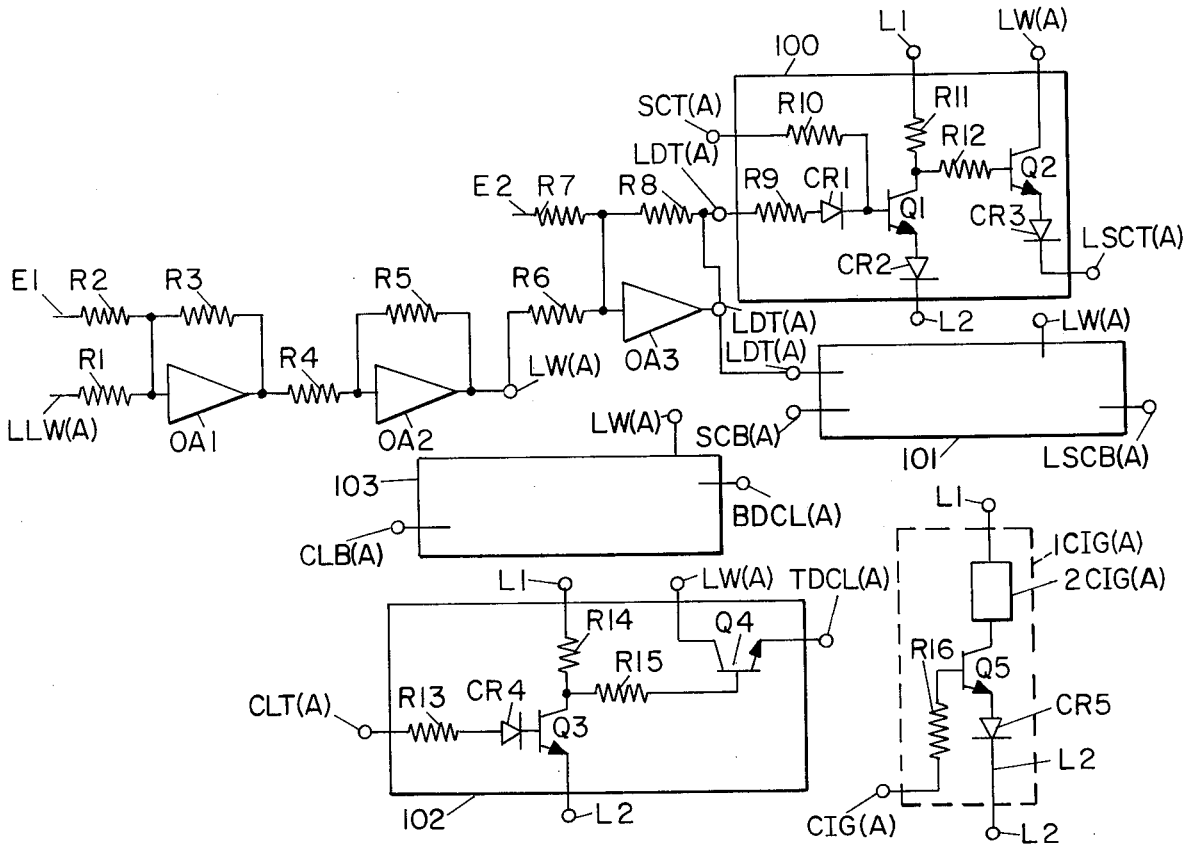
FIG. 2 is a simplified schematic diagram of circuits individual to each car.

In FIG. 2 of the drawing are four solid lines rectangular shaped blocks 100, 101, 102 and 103. Each of these represents an electronic switch. The simplified wiring diagrams shown in two of these blocks 100 and 102 are included only to illustrate the switch design arrangements used in them and in switches 101 and 103 respectively in the presently constructed embodiment of the invention. Each such switch is identified and referred to in the specification by its associated numerical characters.

In addition a dotted line rectangular shaped block 1CIG(A) enclosing a simplified wiring diagram of a typical relay circuit is shown in FIG. 2 of the drawing. A similar dotted line rectangular block identified by the reference characters of an associated input signal to which a prefix numeral has been affixed is used to represent each relay circuit in the remaining figures of the drawing. It is understood that each coil of each relay circuit is energized when the input signal shown to the left of each representation is of sufficient magnitude to cause a required minimum operating current to flow through the coil of the relay. The contacts of each relay are shown in their unoperated condition and remote from the rectangular representation of the associated relay circuit with the same reference characters as the input signal of that circuit and with appropriate numerical suffixes to identify one set of contacts of a relay from another set of contacts of the same relay.

Figure 1:
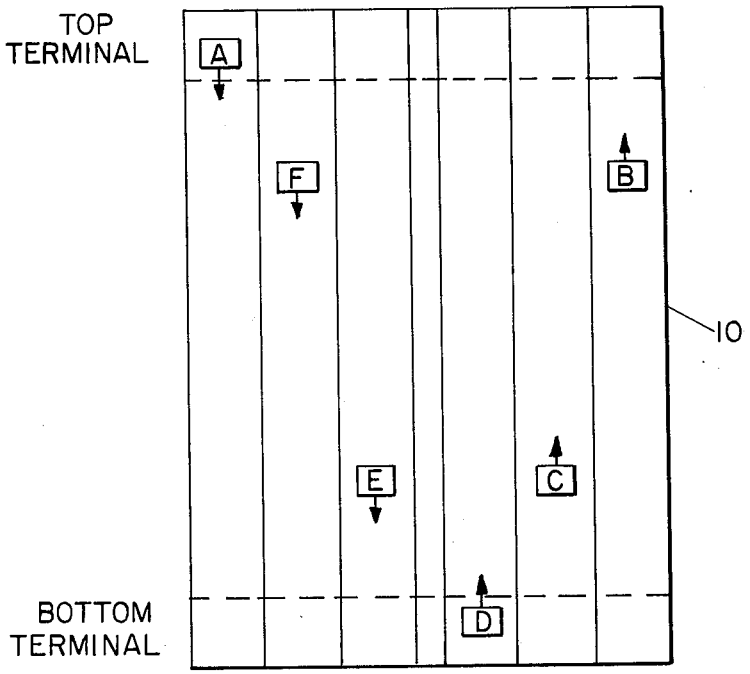
FIG. 1 illustrates a plurality of cars A, B, C, D, E and F operating between two dispatching terminals.

Illustrated in FIG. 1 are six cars A, B, C, D, E and F of an elevator group which serves two terminals identified as the top and bottom terminals of building 10. As shown the system is balanced, i.e., the dispatching time intervals between cars successively dispatched from each of the terminals are equal. As is known each of the cars operates under the control of an elevator control system (not shown) in response to dispatching signals generated at intervals determined by the apparatus of this invention.

Each of the cars is provided with circuitry similar to the circuitry shown for car A in FIG. 2. A load transducer (not shown), mounted in car A in any well known manner, generates a signal representing the weight of the passengers in car A. This signal is transmitted to the input of operational amplifier OA1 through input resistor R1 along line LLW(A). In addition, as is typical, a signal is applied along line E1 through input resistor R2 of operational amplifier OA1 to provide in conjunction with feedback resistor R3 a proper scaling for the signal from the load transducer. In this constructed embodiment the scaling varies the output signal linearly from 0 volts for no passengers on car A to 10 volts when car A is fully loaded. The properly scaled output signal from operational amplifier OA1 is transmitted through resistor R4 to the input of inverting amplifier OA2. The scaled output signal from operational amplifier OA2 on line LW(A) continuously representing the weight of the passengers in car A is applied to the four electronic switches 100, 101, 102 and 103 and is also transmitted through resistor R6 to the input of operational amplifier OA3. A second signal is also applied along the line E2 to the input of operational amplifier OA3, arranged as a comparator. When the signal on line LW(A) transmitted through input resistor R6 of operational amplifier OA3 exceeds the fixed signal from line E2 transmitted through a second input resistor R7 a negative signal appears at the output of the comparator circuit on line LDT(A) shown connected to electronic switches 100 and 101.

Electronic switch 100 operates in response to the two signals applied to it along lines LDT(A) and SCT(A) to transfer the signal applied to it along line LW(A) to its output on line LSCT(A) connected to a first dispatching generator. The signal on line LDT(A) is applied through input resistor R9 of electronic switch 100 to the anode of rectifier CR1 and from its cathode to the base of transistor Q1. That base of that transistor is also connected to one end of resistor R10, the other end of which is connected to a second input line SCT(A) of electronic switch 100. Rectifier CR2 has its anode connected to the emitter of transistor Q1 and its cathode connected to line L2. Transistor Q1 collector is connected to one end of resistor R11 which is also connected to line L1 and is connected to resistor R12 which has its other end connected to the base of transistor Q2. A signal from the output of operational amplifier OA2 is applied along the line LW(A) to the collector of transistor Q2 for transmission from its emitter to the anode of rectifier CR3. The cathode of rectifier CR3 is connected to the output line LSCT(A) of switch 100. The magnitude of the signal on line LSCT(A) represents the weight of the passengers in car A. It is applied along line LSCT(A) when car A has been selected by the elevator control system as the next car to be dispatched from the top terminal as signified by the application of a signal representing that selection along line SCT(A).

Electronic switch 101, shown as a solid line rectangular block responds similarly to the signals applied to it along lines LDT(A) and SCB(A) to transfer the signal on line LW(A) to its output on line LSCB(A) connected to a second dispatching signal generator. The magnitude of the signal on line LSCB(A) also represents the weight of the passengers in car A. It is applied along line LSCB(A) when car A has been selected as the next car to be dispatched from the bottom terminal as signified by the application of a signal representing that selection along line SCB(A).

Electronic switch 102 (FIG. 2) operates in response to a signal from the elevator control system applied to it along the line CLT(A) to transfer a second signal from the output of operational amplifier OA2 applied to it along the line LW(A) to its output line TDCL(A). The signal on line CLT(A) is applied through input resistor R13 to the anode of rectifier CR4 and from its cathode to the base of transistor Q3 when car A leaves the top terminal and for a suitable time thereafter obtained in any well known manner. A suitable time is at least a period equivalent to a single time constant of the integrating amplifier of the accumulation means to be described with respect to FIG. 3. The emitter of transistor Q3 is connected to line L2 and its collector is jointly connected to one end of resistor R14, the other end of which is connected to line L1, and to one end of resistor R15. Resistor R15 has its second end connected to the base of transistor Q4. Line LW(A) is connected to the collector of transistor Q4, the emitter of which is connected to line TDCL(A). The magnitude of the signal on line TDCL(A) also represents the weight of the passengers in car A and is applied on line TDCL(A) when that car leaves the top terminal.

In a similar manner electronic switch 103 responds to the signal from the elevator control system applied to it on line CLB(A) to transfer the signal from amplifier OA2 applied to it on line LW(A) to its output on line BDCL(A). The signal on line CLB(A) is applied to switch 103 when car A leaves the bottom terminal and for a suitable time thereafter in any well known manner. A suitable time period in this case is the same period as described for signal CLT(A). The signal on line BDCL(A) also represents the weight of the passengers in car A and is applied when car A leaves the bottom terminal.

Each of the cars also has individually associated with it a relay circuit similar to the one shown for car A identified as 1CIG(A) and enclosed by the dotted line rectangular block in FIG. 2. If car A is operating as a part of the group of elevators serving the building, a signal signifying this is transmitted from the elevator control system along the line CIG(A) and as a result relay 2CIG(A) is operated to close its normally open contacts 2CIG(A)1 (FIG. 5).

In FIG. 3 of the drawing the output line TDCL(A) of electronic switch 102 (FIG. 2) is shown connected through input resistor R17 (FIG. 3) to operational amplifier OA4. It is understood that additional input resistors are provided through which similar output lines from the switches of cars B, C, D, E and F corresponding to that of switch 102 of car A are connected to the input of amplifier 0A4. Additionally, line −LT from amplifier 0A6 is connected through feedback resistor R18 to the input of operational amplifier OA4. The output of amplifier OA4 is connected through a set of normally open contacts 2GCLT1 of switch 2GCLT and resistor R24 to the input of operational amplifier OA5. The coil of switch 2GCLT is connected to receive a signal transmitted from the elevator control system along line GCLT in any well known manner whenever a car leaves the upper terminal in response to a dispatching signal. This signal is applied through the parallel resistor capacitor combination R20, C1 and series resistor R21 to the base of transistor Q6. As a result relay 2GCLT operates to close its normally open contacts 2GCLT1 and 2GCLT2. The latter contacts upon closing connect the timing circuit comprising resistor R23 and capacitor C2 which form part of a signal transmission means to the base of transistor Q6. Relay 2GCLT is maintained in its operated condition for a time period determined by the charging rate of capacitor C2 for a single time constant of the resistor capacitor combination of R24 and C3 associated with integrating amplifier OA5. During that time period operational amplifier OA5, arranged as an integrator, operates as an accumulation means to vary exponentially the charge stored on its feedback capacitor C3 in accord with the differential signal applied to its input from amplifier OA4 to produce an exponentially averaged signal on its output. This represents an accumulated weight of passengers in the cars dispatched from the top terminal. The signal from the integrator is transmitted through isolation diode CR6 to operational amplifiers OA6 and OA7, arranged as inverting amplifiers which are connected in series, to produce signals on lines −LT and LT respectively which are used to represent the weight of the passengers the system estimates will be in the next car to be dispatched from the upper terminal at the end of its dispatching interval.

Another accumulation means similar to that described above for the upper terminal is also shown in FIG. 3. This second accumulation means is connected to receive signals from switch 103 for car A and the corresponding switches for the other cars. It provides at outputs of inverting amplifiers OA10 and OA11 on lines −LB and LB signals representing the weight of the passengers the system estimates will be in the next car to be dispatched from the bottom terminal at the end of the dispatching interval. Hereinafter, the weights the system estimates for cars to be dispatched from the upper and lower terminals will be referred to as the estimated weights.

Two exponential curves of the charging and discharging patterns of integrating amplifier OA5 are illustrated in FIG. 4. Each intersection of the vertical lines with the curves signifies the estimated weight of the passengers in the particularly identified car A, B, C, D and E under certain assumed conditions at the expiration of its dispatching interval. The assumed conditions for the increasing curve are that the cars are being dispatched from the top terminal in the order A, B, C, D, E and F, that each of the four or five cars dispatched prior to car F left the upper terminal 50% loaded and that car F as well as cars A, B, C, D and E will leave the upper terminal 75% loaded. The assumed conditions for the decreasing curve are the same dispatching order and that each of the four or five cars dispatched prior to car D left the lower terminal 50% loaded and cars D, E, F, A and B will leave the lower terminal 25% loaded.

The signals on lines LT and LB representing the estimated passenger weight in the next cars to be dispatched from the upper and lower terminals are utilized by the signal generators shown in FIG. 5 to generate a signal representing the computed separation time period each car of the system should be separated from the car next preceding and the car next succeeding its dispatch if each of the cars is sharing equally the estimated loading at the terminals.

FIG. 5 includes a simplified schematic of a means for computing a separation time period which produces a signal on line −TS representing the time period each dispatched car of the system would be separated from the car next preceding and the car next succeeding its dispatch if each of the cars is equally sharing the estimated loading at the two terminals. Hereinafter this means will be referred to as a computed separation time period generating means. As shown, operational amplifier OA12, arranged as a summing amplifier has applied to it input signals along the lines LT and LB through resistors R42 and R43. In response, it produces an output signal which is applied through resistor R45 to the input of operational amplifier OA13. A bias signal, representing two hereinafter described constants affecting the operation of each of the cars of the system, is also applied along line E3 through a second input resistor R46 to the input of summing amplifier OA13. Amplifier OA13 is shown with a resistor R47 connected in series with open contacts 2CIG(A)1 as one of its feedback circuits. It is understood that each of the additional parallel feedback circuits shown in FIG. 5 represent corresponding circuits associated with cars B, C, D, E and F. In addition it should be understood that the input resistors and the feedback resistors have been arranged to reduce the gain of amplifier OA13 so that it divides the sum of its input signals by the number of cars operating in the group. Contacts 2CIG(A)1 and the corresponding contacts of each of the other cars are closed to effect the proper division when the associated car is operating in the group. The output of amplifier OA13 is transmitted through resistor R48 to the input of operational amplifier OA14 arranged as an inverting amplifier to produce a signal on line −TS for use by the dispatching interval generating means shown in FIG. 5.

The dispatching interval generating means of FIG. 5 employs the computed separation time period signal on line −TS both on the upper terminal generator and on the lower terminal one. Only the upper terminal dispatching interval generator is described, it being understood that a similar description applies to the lower terminal dispatching interval generator. Signals from the elevator control system applied along lines CIT(A) and UDC(A) signifying that car A is idle at or moving in the direction of the upper terminal are applied to the input of operational amplifier OA15 through input resistors R50 and R51. The additional input resistors of amplifier OA15 shown in the figure are connected to ten additional input lines from the elevator control system along which are applied signals corresponding to those on lines CIT(A) and UDC(A) for the remaining cars of the system. In addition the elevator control system provides signals signifying that car A is idle at or moving in the direction of the lower terminal which are applied along the lines C1B(A) and DDC(A) to input resistors R52 and R53 of summing amplifier OA16. Ten additional resistors are connected to summing amplifier OA16 and to the additional lines from the elevator control system along which are applied corresponding signals from the remaining cars idle at or moving in the direction of the lower terminal. Amplifiers OA15 and OA16 produce output signals representing the sum of the cars idle at and moving toward the upper terminal and the sum of the cars idle at and moving toward the lower terminals respectively. The output signal from operational amplifier OA15 is transmitted through input resistor R55 to inverting amplifier OA17. In response to both input signals applied to it from the output of inverting amplifier OA17 through resistor R57 and from the output of summing amplifier OA16 through resistor R58 operational amplifier OA18, arranged as an integrator operates as a car differential means and produces a signal on its output representing the integral of the difference between the cars that are approaching and are located at the upper terminal and the cars that are approaching and are located at the lower terminal during each dispatching interval that elapses. That output signal from integrating amplifier OA18 is transmitted through resistor R59 to the input of summing amplifier OA19 and is combined thereat with a loading differential signal produced by the subtraction of the estimated passenger weight signals from the upper terminal accumulation means (FIG. 3) applied along the line LT from the corresponding signals of the lower terminal accumulation means applied along the line −LB through resistor R60 and R61 respectively to inputs of operational amplifier OA19. Summing amplifier OA20 responds to both the output signal of operational amplifier 0A19 applied to it through diode CR10 in series with input resistor R63 and to the signal from the computed separation time period generating means on line −TS applied to it through its second input resistor R64 to produce a signal on line TT representing the dispatching interval for the upper terminal. Diode CR10 (FIG. 5) transmits only positive signals from the output of operational amplifier OA19 whereby the magnitude of the car and loading differential signals can only be subtracted from the signal on line −TS to produce the signal on line TT.

Also illustrated in FIG. 5 is relay circuit 1GDST which transfers the relay 2GDST (coil not shown) to its operated conditions in response to a signal applied along line GDST by the elevator control system. This signal is of short duration and is applied to line GDST by the elevator control system in any well known manner in response to the control system signifying the application of an upper terminal dispatching signal by the apparatus of this invention. As a result, at the end of the upper terminal dispatching interval contacts 2GDST1, connected across feedback capacitor C7 of integrating amplifier OA18, are closed thereby providing a discharge path for the charge accumulated on capacitor C7 during the elapse of the last upper terminal dispatchng interval.

The lower terminal dispatching interval generating means illustrated in the lower portion of FIG. 5 operates in a similar manner to the upper terminal dispatching interval generating means to produce a signal on the output of operational amplifier OA24 along line TB which represents the dispatching interval for the lower terminal. That signal is obtained as a result of the combination of the output signal from integrating amplifier OA22 applied through resistor R71 to the input of operational amplifier OA23 representing the difference between cars located at or approaching the lower terminal and the cars located at or approaching the upper terminal during each dispatching interval that elapses and of the differential signals produced by the subtraction of the estimated weight signals from the lower terminal accumulation means applied along line LB from the corresponding signals of the upper terminal accumulation means applied along the line −LT through input resistors R72 and R73 respectively to the input of operational amplifier OA23. Summing amplifier OA24 responds to both the output signal from operational amplifier OA23 applied to it through diode CR11 and resistor R75 and to the signal from the computed separation time period generating means on line −TS applied to it through resistor R76.

Illustrated in the upper section of FIG. 6 is a simplified wiring diagram of the upper and lower terminal dispatching signal generators used with the preferred embodiment of the invention. Since each of these generators is similar only the upper terminal dispatching signal generator will be described it being understood that a corresponding description applies to the lower terminal dispatching signal generator.

As shown in FIG. 6 a signal from line E4 is applied through resistor R78 to the input of operational amplifier OA25 arranged with feedback capacitor C9 to form an integrator. Contacts 2GDST2, shunting feedback capacitor C9, are closed at the end of each dispatching interval to provide a discharge path for the charge accumulated on capacitor C9 during the elapse of each upper terminal dispatching interval when relay 2GDST of circuit 1GDST illustrated in FIG. 5 is operated as previously explained. During each dispatching interval integrator OA25 generates a ramp signal on its output which is transmitted through resistor R79 to the input of operational amplifier OA26. Operational amplifier OA26 functions as a comparator to produce a positive output signal when the magnitude of the ramp signal applied to it through input resistor R79 from the output of integrating amplifier OA25 exceeds the magnitude of the second signal applied to it through input resistor R80 from the line TT. The output signal from operational amplifier OA26 is transmitted through diode CR12 to the input of voltage follower amplifier OA27. This apparatus operates as the upper terminal dispatching interval generator and transmits upper terminal dispatching signals on line CDT to the elevator control system.

In addition, the input of operational amplifier OA27 functions as a summing point for the outputs of additional circuitry designed to generate dispatching signals when special conditions are met. One of those circuits, shown in FIG. 6, transmits a signal from operational amplifier OA28 through diode CR13 to voltage follower OA27 whenever the actual weight of the passengers in a car selected for dispatch from the upper terminal exceeds the estimated weight of the passengers for that car by a prescribed value. For this purpose the output signal on line LSCT(A) from electronic switch 100 (FIG. 2) signifying the weight of the passengers in selected car A is transmitted to the input of operational amplifier OA29. In addition the upper terminal estimated weight signal applied along line −LT is transmitted through input resistor R82 to the input of operational amplifier OA29 which generates an output signal when the signal on line LSCT(A) exceeds the signal on line −LT by a predetermined amount. The output signal from operational amplifier OA29 is transmitted through input resistor R84 to inverting amplifier OA28 to generate a load dispatch signal. It is to be understood that signals from the additional cars which are generated in the same manner as the signal on line LSCT(A) are applied as additional inputs to operational amplifier OA29 along corresponding lines connected to the input of this amplifier.

The lower terminal dispatching signal generator illustrated in FIG. 6 includes a bias signal E5 applied through resistor R86 to the input of operational amplifier OA30 arranged with feedback capacitor C10 to form an integrator. Normally open contacts 2GDSB2 of relay 2GDSB are connected in parallel with capacitor C10. In response to both input signals applied to it from the output of amplifier OA30 and along the line TB from amplifier OA24 (FIG. 5) through resistors R87 and R88 respectively, amplifier OA31 produces dispatching signals which are transmitted through diode CR14 to voltage follower OA32.

In addition diode CR15 connects the output of operational amplifier OA33 to the input of voltage follower OA32. As shown a signal representing the actual weight of the passengers in car A is transmitted from switch 101 (FIG. 2) along line LSCB(A) to the input of operational amplifier OA34 when that car has been selected for dispatch from the lower terminal. Amplifier OA34 has five additional inputs which are connected to lines from corresponding switches associated with each of the additional cars. In addition the lower terminal estimated weight signal from amplifier OA10 (FIG. 3) is applied along line −LB through a resistor R90 to the input of operational amplifier OA34. Amplifier OA34 produces a load dispatch signal which is transmitted through resistor R92 to the input of operational amplifier OA33 when the signal representing the actual weight of the passengers in a car selected for dispatch exceeds the lower terminal estimated weight signal by a predetermined amount.

Two additional signal generators are shown in the lower section of FIG. 6. Signals are applied along line E6 through resistor R94 to operational amplifier OA35. These signals are compared with signals applied to the amplifier along line −(LB+LT) from amplifier OA12 (FIG. 5) through resistor R95. When the former signals exceed the latter signals by a predetermined amount operational amplifier OA35 produces an output signal signifying that the estimated number of passengers in the selected cars awaiting dispatch from both of the terminals is less than a predetermined value. That output signal is applied through resistor R97 to the input of operational amplifier OA36 which produces a signal on the line STO signifying that a car may be placed in storage. Subsequently, after a car has been removed from service in response to the signal on line STO, the elevator control system transmits a signal along the line GAS to the input 13 of flip-flop FF1 signifying that a car has been removed from group service. As a result, output 5 of flip-flop FF1 is transferred to its "off" state and current flows from line L1 through resistor R99 into the base of transistor Q8 thereby switching transistor Q8 to its "on" state. Current therefore flows from line L1, through resistor R100 into the collector and from the emitter of transistor Q8 through resistor R101 into the input of operational amplifier OA37. If that current exceeds the signal from line E8 transmitted through resistor R102 to the second input of operational amplifier OA37, the amplifier produces an output signal which is transmitted through diode CR16 and series resistor R104 to the input of operational amplifier OA36. The output signal from operational amplifier OA37 inhibits operational amplifier OA36 from producing a signal on line STO until the timing circuit described hereinafter restores flip-flop FF1 to its original state.

Since the second output of the flip-flop FF1 was switched ot its "on" state at the same time that output 5 was switched to its "off" state, this second output 6 applies a signal to the base of transistor Q9. As a result the transistor is switched to its "off" state and current flows from line L1 through resistors R105 and R106 to capacitor C11. When the voltage across the capacitor C11, connected across the input terminals of unijunction transistor Q10 exceeds the minimum excitation voltage of the unijunction transistor, that transistor conducts and thereby produces a reset pulse which is applied to line 1 of flip-flop FF1. This resets the flip-flop to its original state and as a consequence the output signal from operational amplifier OA37 no longer produces an output which can inhibit operational amplifier OA36. A suitable time period for resetting the flip-flop has been determined to be two minutes. After the resetting, the process of storing a car can be repeated as often as necessary until the car supply adequately meets the estimated demand for service at which time the signal on line −(LB+LT) is no longer less than the bias signal from line E6.

Operational amplifier OA38 of the second signal generator shown in the lower section of FIG. 6 operates in response to the bias signal applied to it along the line E7 through resistor R109 and the signal applied to it along the line −(LB+LT) through resistor R110 to produce an output signal along the line RES when the signal on line −(LB+LT) exceeds the predetermined value signified by the bias on line E7. The signal on line RES signifies that the number of operating cars is inadequate to meet the expected demand and is applied to the elevator control system to cause it to restore stored cars to service.

To more fully appreciate the invention and the manner in which the presently preferred embodiment operates to generate dispatching signals at each of a pair of terminals whereby each of the cars is dispatched at intervals to more equally share the estimated loading at each of the terminals assume, as shown in FIG. 1, that a six car bank of elevators A, B, C, D, E and F serves only the upper and lower terminals of building 10 and the system has power applied to it. As a result the elevator control system of each car operating in the group transmits signals on line CIG(A). etc. (FIG. 2) to each associated relay circuit 1CIG(A), etc. (only that one associated with car A being shown), thereby operating each respective relay 2CIG(A). Each of these relays closes its contacts 2CIG(A)1, etc. (FIG. 5) thereby adding six parallel feedback resistors to operational amplifier OA13. Additionally, it is assumed that each car is provided with a load weighing transducer which continuously transmits a signal along the lines LLW(A), etc. representing the weight of the passengers in each car.

It is also assumed that equal numbers of passengers are awaiting service at each terminal and, as shown in FIG. 1, cars A and D are selected and awaiting dispatch at the upper and lower terminals respectively. As a result the elevator control systems transmits signals on lines CIT(A) and CIB(D) (FIG. 5) to the dispatching interval generating means shown in FIG. 5. Additionally, it is assumed as shown in FIG. 1 that two pairs of cars B, C and E, F each previously dispatched from the lower and upper terminals respectively are approaching the upper and lower terminals and as a result, the elevator control system transmits signals on lines UDC(B), UDC(C) and DDC(E), DDC(F) (FIG. 5) to the same dispatching interval generating means.

In order to generate dispatching intervals for cars A and D a signal signifying an estimated weight of the passengers on each of the cars is generated by the upper and lower accumulation means of FIG. 3.

To understand how the accumulation means of FIG. 3 operates to obtain the values of the estimated weight of the passengers on the cars, assume that the conditions previous to those shown on FIG. 1 where such that the signals along lines LT and −LT had values of 5.0 and −5.0 volts respectively at the time car F was awaiting dispatch. The 5 volt magnitude resulted from each of the cars A, B, C, D and E having previously left the upper terminal each with 50% of its full load. Also assume that sufficient passengers entered car F before it could close its doors and leave in response to a dispatching signal such that it left the upper terminal 75% loaded. As a consequence of this departure of the car, signals applied along line CLT(F) (not shown but corresponding to line CLT(A) FIG. 2) and along line GCLT (FIG. 3) caused the following voltages to be produced in accordance with the scale chosen for the constructed embodiment. On line TDCL(F) (FIG. 3) 7.5 volts were produced owing to the 75% load on car F. This caused amplifier OA4 to produce an output of −2.5 volts.

When contacts 2GCLT1 closed, as a result of the application of the signal from the elevator control system along line GCLT, this −2.5 volt signal was applied to the input of amplifier OA5 for a period equal to one time constant of that amplifier. In consequence at the end of that period the voltage on line LT was 6.58 volts. This 6.58 volt signal was produced because the −2.5 volt signal from amplifier OA4 caused integrating amplifier OA5 to operate during the one time constant provided by the closing of contacts 2GCLT1 to increase its signal to the 6.58 volt value from its previous 5.0 volt value in accordance with standard integrating amplifier operation. Under the assumed conditions the system has estimated that the weight of the passengers aboard car A at the end of its dispatching interval will be 65.8% of full load.

Likewise it can be shown that if the signals along lines LB and −LB had values of 5.0 and −5.0 volts respectively at the time that car C was awaiting dispatch from the bottom terminal and if car C left that terminal with only a 25% load that the signal along lines LB and −LB would be changed to 3.42 volts and −3.42 volts respectively after car C was dispatched. Under this condition the estimated weight of passengers for car D at the end of the dispatching interval at the lower terminal will be 34.2% of full load.

From the foregoing the manner in which both the upper and lower accumulation means function to produce the signals representing the estimated weight of passengers for the next car awaiting dispatch should be readily understood by those skilled in the art.

The signals on lines LT and LB representing the estimated passenger weight in the next cars to be dispatched from the upper and lower terminals are utilized by the signal generators shown in FIG. 5 to generate a signal representing the computed time separation period each car of the system should be separated from the car next preceding and the car next succeeding its dispatch if each of the cars is sharing equally the estimated loading at the terminals.

The computation of the separation time period is based upon the assumption that the cars will be separated one from the other as desired so as to have the loading equally shared if the passenger loading conditions are stable for a sufficient period provided the separation time is derived by dividing the total time expended by the group (RT) in operating during any interval by the number of cars operating in the group. The total time expended by the group in operating during any interval includes the non-stop round trip running time of each car (RO) during that interval, the terminal time allotted all the cars located at each terminal (TST) during that interval and the terminal delay times resulting from the passengers entering the selected car. In installations of the type under consideration the running times (RO) of each of the cars during an interval and the terminal time (TST) allotted all the cars during an interval are equal respectively to the actual non-stop round trip running time of one car and the actual terminal time allotted one car at each of the terminals if the passenger loading conditions are stable for a sufficient period and if the system is operating to dispatch car such that they share the passenger loading equally as is desired. Consequently, these two factors may be considered constant and as a result the only variables in computing the separation times are the delays caused by the passengers entering each of the cars at each terminal. Since those delays are dependent on the total number of passengers in the cars at dispatch, an estimate of the delays may be obtained from the properly scaled estimated passenger weights in the next car to be dispatched from each terminal.

For this purpose the signals on lines LT and LB representing the estimated passenger weights at the upper and lower terminals are combined in amplifier OA13 with a fixed bias signal from line E3 representing the non-stop round trip running time (RO) and the terminal time allotted all the cars located at each terminal (TST). Amplifier OA13 through the parallel feedback circuits comprising contacts 2CIG(A)1, etc. divides these combined signals to generate a signal along line TS signifying the computed separation time period. Under the assumed conditions the signals along lines LB and LT having been previously 5.0 volts each and having changed because of the loading on cars C and F to 6.58 volts and 3.42 volts, respectively, it can be seen that the signal along the line TS will remain the same.

That signal is inverted and transmitted along line −TS from the computed separation time period generating means to the dispatching interval generating means where it is combined with the signals from the car and loading differential means to generate signals representing the dispatching intervals for each terminal along lines TT and TB in accordance with the following equations:

$$TT = TS - K2\left[\int_0^{TT} \{\Sigma(CIT - CIB) + \Sigma(UDC - DDC)\}DT + (LB - LT)\right] \quad (1)$$

$$TB = TS - K2\left[\int_0^{TB} \{\Sigma(CIB - CIT) + \Sigma(DDC - UDC)\}DT + (LT - LB)\right] \quad (2)$$

TT = down dispatching interval of the next selected car to be dispatched from the top terminal — car A under the assumed conditions.

TB = up dispatching interval of the next selected car to be dispatched from the bottom terminal — car D under the assumed conditions.

TS = computed separation time period.

K2 = adjustable constant

CIT = car idle at upper terminal during the interval that is elapsing.

CIB = car idle at lower terminal during the interval that is elapsing.

UDC = up dispatched cars or cars running in the up direction.

DDC = down dispatched cars or cars running in the down direction.

As a result of the assumed conditions the car differential components of equations 1 and 2 representing the running and idle cars cancel each other during each of the elapsing intervals for cars A and D. In other words the car differential components (UDC-DDC), (DDC-UDC), (CIT-CIB) and (CIB-CIT) are all zero during those intervals and have no effect in those intervals. However, the load differential components (LT-LB) is equal to 3.16 volts. A percentage of this voltage is subtracted from the voltage representing the computed separation time period (TS) to produce a reduced lower terminal dispatching interval. The percentage depends on the value at which the constant K2 of equation 2 is adjusted. The upper terminal dispatching interval load differential component (LB-LT) is equal to −3.16 volts but this does not reduce the upper terminal dispatching interval since only positive voltage signals can pass through diode CR10.

As a result of the decrease in the up dispatching interval and the signal on line TB while the down dispatching interval and the signal on line TT remain the same the lower terminal dispatching signal generator generates a dispatching signal on line CDB (FIG. 6) prior to the generation of a dispatching signal on line CDT (FIG. 6) by the upper terminal dispatching generator. If the last assumed passenger status remains constant it can be appreciated that because of the disparity in dispatching intervals wherein cars are dispatched at shorter intervals from the lower terminal than from the upper terminal and the number of cars located at or approaching the upper terminal will exceed the number of cars located at or approaching the lower terminal. As a result the car differential means produces a signal which will ultimately offset the signals from the loading differential means as shown in equations 1 and 2. Thus when the signal from the car differential means equals the signal from loading differential means each car is again dispatched from each terminal at intervals determined by the signals on line −TS generated by the computed time period generating means since at that time.

$$\int_0^{TB} [\Sigma(CIB - CIT) + \Sigma(DDC - UDC)]DT = (LB - LT) \quad (3)$$

$$\int_0^{TT} [\Sigma(CIT - CIB) + \Sigma(UDC - DDC)]DT = (LT - LB) \quad (4)$$

From the foregoing it should be understood that the apparatus of the present invention varies the dispatching intervals in order to have each of the cars share equally the estimated loading at the two terminals.

It is also understood that the apparatus of this invention can be utilized with an elevator system in which the elevator control system operates to start and accelerate each of the cars in the usual manner as a result of calls being placed in registration for service by prospective passengers. However, even if the apparatus of the present invention is combined with such a system and it is assumed that an imbalance in the passenger loading exists such as to produce lower terminal dispatching signals at shorter intervals than the upper terminal dispatching signals it can be appreciated that as a result of the fewer calls being placed in registration for service from the lower terminal the number of cars available for service at the lower terminal can exceed the demand for service at that terminal while the number of cars available for service at the upper terminal can be insufficient to respond to the demand for service at that terminal. It will therefore be appreciated that the signals generated by amplifiers OA19 and OA23 signifying the intergral of the difference between the cars that are approaching and are located at each of the terminals and signals signifying the estimated loads at each of the terminals during each dispatching interval can be applied to the elevator control system which as a result of these signals reaching a predetermined value generates signals to start and accelerate cars from the lower terminal although no calls have been placed in registration for service from that terminal.

It is apparent that various modifications of the above will be evident to those skilled in the art and that the arrangement described herein is for illustrative purposes and is not to be considered restrictive.

What is claimed is:

1. Apparatus for generating dispatching signals for use with an elevator control system which selects and dispatches each of a plurality of cars from each of two terminals at dispatching intervals, said apparatus comprising:

weight responsive means individual to each car, each being responsive to the weight of the passengers in its respective car producing a signal representing that weight;

accumulation means for each terminal receiving said passenger weight signals, each said accumulation means operating in response to said passenger weight signals generating signals representing an estimated loading for the next car to be dispatched from its respective terminal;

signal transmission means for each said accumulation means transmitting the passenger weight signals of each selected car upon its dispatch from each of said terminals to the associated accumulation means;

a computed separation time period generating means responsive to the estimated loading signals of each said accumulation means and generating signals representing the computed time period separating each dispatched car of the system from the car next preceding and the car next succeeding its dispatch if each of the cars is sharing equally the estimated loading at the two terminals;

car differential means associated with one of said terminals producing signals signifying a differential between the cars that are approaching and are located at said one terminal and those that are approaching and are located at the other terminal during each dispatching interval that elapses for said one terminal;

loading differential means associated with said one terminal responsive to the estimated loading signals of each said accumulation means and generating signals signifying a differential between the signals representing the estimated load at said other terminal and the estimated load at said one terminal during each dispatching interval that elapses for said one terminal;

dispatching interval generating means responsive to said computed separation time period signal and to said car and loading differential signals and generating a dispatching interval for each selected car at said one terminal;

and a dispatching signal generator responsive to said dispatching interval generating means generating dispatching signals for each selected car at said one terminal upon an elapse from the disptach of the next preceding car of the time period represented by said dispatching interval for said selected car.

2. Apparatus according to claim 1, including car differential means associated with said other terminal producing signals signifying a differential between the cars that are approaching and are located at said other terminal and those that are approaching and are located at said one terminal during each dispatching interval that elapses, for said other terminal;

loading differential mean associated with said other terminal responsive to the estimated loading signals of each said accumulation means and generating signals signifying a differential between the signals representing the estimated load at said one terminal and the estimated load at said other terminal during each dispatching interval that elapses, for said other terminal;

a dispatching interval generating means for said other terminal responsive to said computed separation time period signal and to said other terminal car and loading differential signals and generating a dispatching interval for said other terminal;

and a dispatching signal generator responsive to said interval generating means associated with said other terminal generating dispatching signals for each selected car at said other terminal upon an elapse from the dispatch of the next preceeding car of the time period represented by said other dispatching interval for said selected car.

3. Apparatus according to claim 1, wherein each said accumulation means includes a capacitive circuit which accumulates the associated passenger weight signals in an exponential manner.

4. Apparatus according to claim 3, wherein each said transmission means transmits each signal representing the weight of the passengers in a dispatched car to its associated accumulation means for a predetermined time interval to produce the estimated loading signal for the next car to be dispatched from the associated terminal.

5. Apparatus according to claim 2, wherein each said dispatching interval generating means operates to permit its respective car and loading differential signals only to reduce said computed separation time period signals.

6. Apparatus according to claim 1, wherein each said dispatching signal generator operates in response to the magnitude of the signal from the weight responsive means of the next car selected for dispatch from the associated terminal exceeding the magnitude of the estimated loading signal for said terminal by a predetermined amount to expedite the dispatching signal for said associated terminal.

7. Apparatus according to claim 1, wherein each said dispatching signal generator operates in response to an estimated loading signal at its associated terminal being less than a predetermined value to generate a signal signifying that a car may be temporarily removed from service.

8. Apparatus according to claim 1, wherein each said dispatching signal generator operates in response to an estimated loading signal at its associated terminal exceeding a predetermined value to generate a signal signifying that a car previously temporarily removed from service may be returned to service.

* * * * *

UNITED STATES PATENT OFFICE

CERTIFICATE OF CORRECTION

PATENT NO. : 4,058,187

DATED : November 15, 1977

INVENTOR(S) : Herbert Jacoby and Arnold Mendelsohn

It is certified that error appears in the above-identified patent and that said Letters Patent are hereby corrected as shown below:

| | | |
|---|---|---|
| Title Page, Left Column: | | After "Assignee" - "United Technologies Corporation, Hartford, Conn." should be --Otis Elevator Company, New York, N.Y.--. |
| Col. 3, line 26 | : | "the" should be --that--. |
| Col. 8, line 18 | : | "resistor" should be --resistors--. |
| Col. 10, line 64 | : | "ot" should be --to--. |
| Col. 15, line 21 | : | "intergral" should be --integral--. |
| Col. 16, line 19 | : | "disptach" should be --dispatch--. |

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*